US006651781B2

(12) United States Patent
Lindegger et al.

(10) Patent No.: US 6,651,781 B2
(45) Date of Patent: Nov. 25, 2003

(54) DEVICE FOR PRODUCING ELEVATOR CAR TRAVEL INFORMATION

(75) Inventors: Urs Lindegger, Contone (CH); Liberto Gentile, Cadenazzo (CH)

(73) Assignee: Inventio AG, Hergisluk NW (CH)

( * ) Notice: Subject to any disclaimer, the term of this patent is extended or adjusted under 35 U.S.C. 154(b) by 0 days.

(21) Appl. No.: 10/281,675

(22) Filed: Oct. 28, 2002

(65) Prior Publication Data

US 2003/0042080 A1 Mar. 6, 2003

Related U.S. Application Data

(63) Continuation of application No. PCT/CH01/00255, filed on Apr. 24, 2001.

(30) Foreign Application Priority Data

Apr. 27, 2000 (EP) ..... 00810362

(51) Int. Cl.[7] ..... B66B 1/34

(52) U.S. Cl. ..... 187/394; 187/286

(58) Field of Search ..... 187/394, 391, 187/287, 390, 288, 399; 73/490, 493

(56) References Cited

U.S. PATENT DOCUMENTS

| | | | | | |
|---|---|---|---|---|---|
| 4,427,095 | A | * | 1/1984 | Payne et al. | 187/394 |
| 4,433,756 | A | | 2/1984 | Caputo et al. | |
| 5,349,854 | A | | 9/1994 | Garrido et al. | |
| 5,578,801 | A | * | 11/1996 | Hofmann | 187/393 |
| 5,621,978 | A | * | 4/1997 | Sarauer | 33/503 |
| 6,008,638 | A | * | 12/1999 | Bleckmann et al. | 324/166 |
| 2001/0035315 | A1 | * | 11/2001 | Lindegger et al. | 187/391 |

FOREIGN PATENT DOCUMENTS

| | | |
|---|---|---|
| DE | 43 21 749 | 11/1994 |
| DE | 44 01 977 | 7/1995 |
| GB | 2 255 246 | 10/1992 |
| JP | 2000104795 | 4/2000 |

* cited by examiner

*Primary Examiner*—Jonathan Salata
(74) *Attorney, Agent, or Firm*—MacMillian, Sobanski & Todd, LLC

(57) ABSTRACT

A device for producing information related to a position of an elevator car in an elevator shaft includes a toothed belt having a plurality of teeth spaced along a length of the belt and mounted in an elevator shaft, an encoder mounted on the elevator car and having a toothed wheel for engaging the teeth, and guide rollers mounted on the elevator car and engaging the toothed belt to urge the plurality of teeth into engagement with the toothed wheel.

13 Claims, 1 Drawing Sheet

DEVICE FOR PRODUCING ELEVATOR CAR TRAVEL INFORMATION

This is a continuation of application no. PCT/CH01/00255, filed on Apr. 24, 2001.

BACKGROUND OF THE INVENTION

The present invention relates to equipment for producing shaft information in an elevator shaft, in which a coded strip is arranged over the shaft height, wherein the code of the strip is readable by means of a sensor device arranged at an elevator car movable in the elevator shaft and is convertible into travel parameters of the elevator car.

Equipment for the generation of shaft information, by means of which the absolute position of the elevator car is determined, has become known from the U.S. Pat. No. 4,433,756. An extensible apertured strip tensioned over the shaft height is scanned by means of an optical reader arranged at the elevator car. The apertured strip has two tracks, wherein one track represents the binary coded car position and the other track has openings at regular intervals over the entire strip length. The first track is scanned by an optical reader and the second track by two optical readers and the direction of the movement of the elevator car is determined therefrom.

A disadvantage of this known equipment resides in the fact that the strip has to be supported at several points over the shaft height. It is further disadvantageous that temperature fluctuations have a direct effect on the accuracy of the shaft information. Moreover, the apertured strip is contaminated with oil-laden dust due to the air circulation prevailing in the elevator shaft, as a result of which problems and inaccuracies arise in the optical scanning of the perforations.

SUMMARY OF THE INVENTION

The present invention concerns a device for producing information related to a position of an elevator car in an elevator shaft. The device includes a toothed belt having a first length greater than a second length of a travel path of an elevator car in an elevator shaft in which the toothed belt is to be installed, the toothed belt having a plurality of teeth spaced along at least a portion of the first length, an encoder adapted to be mounted on the elevator car, the encoder having a toothed wheel for engaging the plurality of teeth, and at least one guide roller adapted to be mounted on the elevator car for engaging the toothed belt and urging the plurality of teeth into engagement with the toothed wheel. The toothed belt has spring characteristics for self-tensioning when installed in the elevator shaft. A pair of transverse beams adapted to be fixedly mounted at upper and lower positions in the elevator shaft are provided and opposite ends of the toothed belt are connected to associated ones of the transverse beams.

The toothed belt can have a marking on at least one side to enable a twist-free mounting in the elevator shaft and the marking can be a color of the at least one side. The encoder stores an absolute position of the elevator car in a non-volatile manner. The absolute positional information of the elevator car enable determination of the absolute position of the elevator car in the elevator shaft, the speed of the elevator car and the travel direction of the elevator car.

The advantages achieved by the device according to the present invention are substantially to be seen in the fact that the equipment is largely maintenance-free, cannot be contaminated and is constructed from usual commercial parts. In the case of power failure the equipment according to the present invention does not lose the positional information and learning travels after the power failure are not necessary. Moreover, the equipment replaces all non-safety-relevant shaft switches for producing shaft information. The toothed belt serving as an information transmitter is disposed in fixed engagement with the encoder, so that slipping between the toothed belt and encoder cannot occur. The toothed belt, which is tensioned over the shaft height at two ends, is simple to mount. Since the toothed belt has a reinforcement with spring characteristics, no additional tensioning elements in the form of, for example, tension springs are necessary for the mounting. The ends of the toothed belt can each be formed into a respective eye and be connected with the toothed belt by means of a clip. The eye loops around a cylindrical mount arranged in the shaft. Changes in the constructional body due to temperature or aging do not have any influence on the accuracy of the equipment according to the present invention, because the toothed belt is always tensioned and the level of a specific floor is always at the same tooth of the toothed belt.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
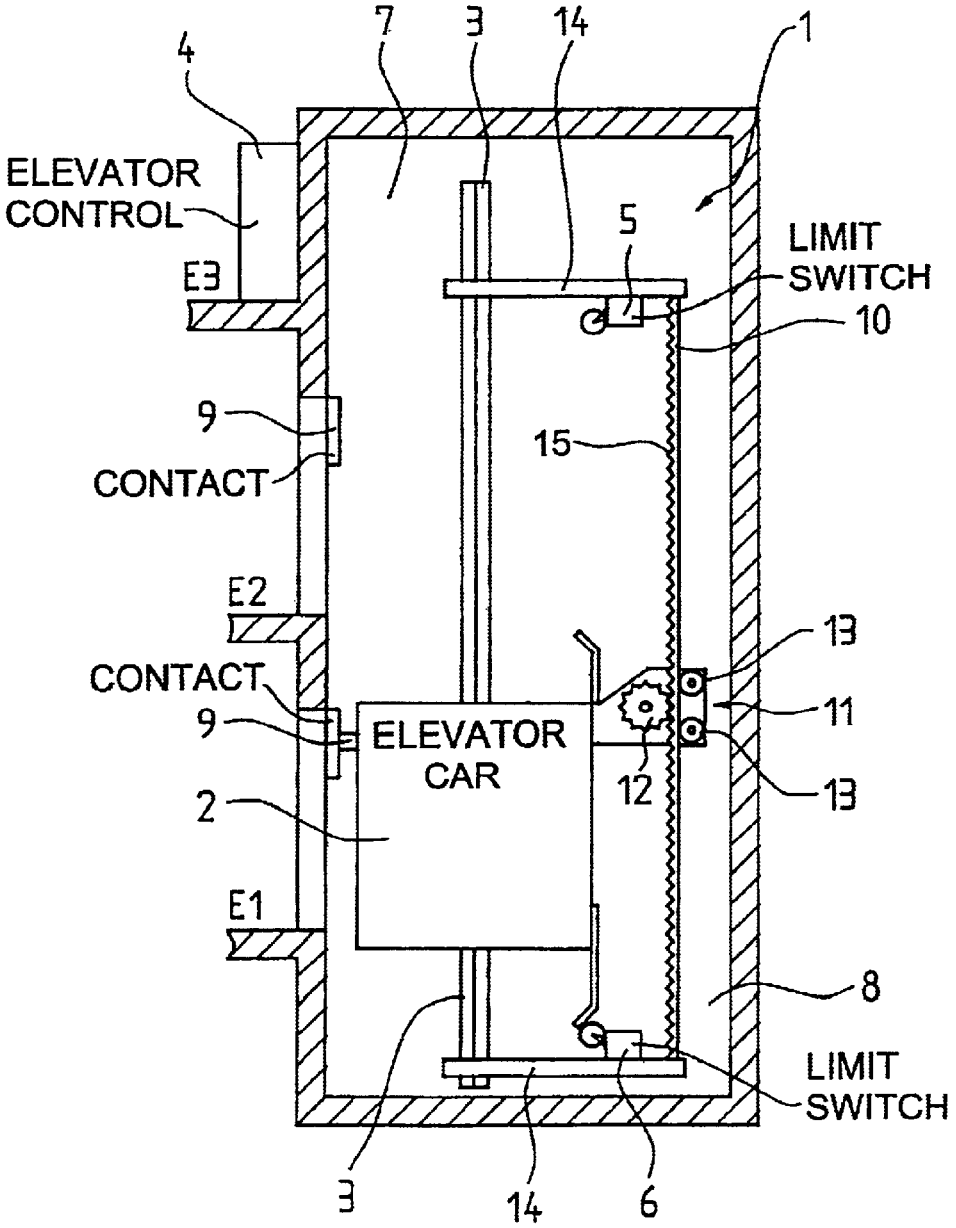
FIG. 1 is a schematic view of a device for producing elevator shaft information in accordance with the present invention.

FIG. 1 shows an elevator installation without a machine room. The device according to the present invention can also be used for elevator installations with a machine room. Not illustrated is the elevator drive with a drive pulley, by way of which the cables are guided which connect an elevator car 2 and a counterweight (not illustrated) for moving up and down in an elevator shaft 1. The elevator car 2 is movable along guide rails 3. An elevator control 4 arranged at a floor E3 controls the elevator drive and the course of movement of the elevator car 2 and ensures the safety of the elevator operation. The control 4 is conventionally connected to the elevator car 2 by a cable (not shown) for the exchange of various signals. The elevator car 2 serves floors E1 and E2. In the illustrated example, an elevator installation is illustrated with two floors, but there can also be more. A safety circuit of the elevator installation consists of a series circuit of contacts of the floor doors (not illustrated) and an upper limit switch 5 and a lower limit switch 6 in the elevator shaft 1. The upper limit switch 5 prevents movement of the elevator car 2 into a shaft head 7 and the lower limit switch 6 prevents movement of the elevator car 2 into a shaft pit 8. On movement of the elevator car 2 into one of the floors E1, E2 a door zone contact 9 is actuated, which bridges over the safety contact of the floor E1, E2, whereby a car door and a floor door can be opened prematurely without the safety circuit being interrupted.

The position of the elevator car 2 in the elevator shaft 1 is of importance for the elevator control 4. For that purpose, equipment for producing shaft information is necessary. In the present example the equipment consists of a toothed belt 10 tensioned over the shaft height and an encoder 11 that is disposed in connection with the toothed belt 10 and which detects the absolute position of the elevator car 2. The encoder 11, which is attached to the elevator car 2, comprises a toothed wheel 12 which, on movement of the elevator car 2 in the elevator shaft 1, is driven by the toothed belt 11. Guide rollers 13 positioned on the opposite side of the toothed belt 10 from the wheel guarantee secure engagement of the toothed wheel 12 in the teeth of the belt 10. The toothed belt 10 is, at each end, arranged at a transverse beam 14 by means of a cylindrical mount. Because the toothed belt 10 has spring characteristics, no additional tensioning elements in the form of, for example, tension springs are needed for the mounting. The ends of the toothed belt 10 can each be formed into an eye and be connected with the toothed belt by means of a clip. The cable eye loops around the cylindrical mount arranged at the transverse beam 14. The toothed belt 10 includes, for example, a steel reinforcement which imparts the spring characteristics to the toothed belt 10. Moreover, the toothed belt 10 has a color marking which enables a twist-free mounting at installation. For example, a side 15 of the belt 10 can be a contrasting color from the other sides of the belt.

A flat belt with a non-skid surface, which bears with sufficient pressure against a pulley of the encoder 11, is also possible instead of the toothed belt 10.

The toothed wheel 12 of the encoder 11 drives a shaft with a coded disc (not shown), the code of which is optoelectronically read and the data filed in a shift register (not shown). In the case of rotation of the coded disc beyond 360°, the coding repeats. In the case of long movement paths such as those of an elevator shaft, a reduction gear is connected between the first code disc and a further code disc, which slows down the further code disc in terms of rotation in a specific ratio to the first code disc. Further reduction gears and code discs can be connected downstream.

The data exchange between the encoder 11 and the elevator control 4 is carried out in such a manner that a clock signal of the elevator control 4 is applied to the shift register, wherein the clock signal controls the serial data transmission to the elevator control 4. The elevator control 4 produces, from the transmitted data, travel parameters of the elevator car 2 such as, for example, the absolute position of the elevator car 2 in the elevator shaft 1, the speed of the elevator car 2 and/or the travel direction of the elevator car 2.

In the case of power failure the positional information of the encoder 11 is maintained by the setting of the code discs. Because the equipment for producing shaft information is also used for evacuation operation, the encoder 11 is operated with battery support. If the encoder 11 produces no or no valid travel parameter, for example in the case of breakage of the toothed belt 10, the elevator car is immediately stopped.

All non-safety-relevant shaft information can be derived with the absolute positional information of the encoder 11. As apparent in the illustrated example, apart from the safety switches 5, 6, 9 in the elevator shaft 1, no switches are necessary. For example, the level of the floor is measured by means of the encoder 11 and communicated to the elevator control 4. For that purpose the elevator car 2 is moved in the elevator shaft 1 to the corresponding level and the absolute positional information of the floor is transmitted to the elevator control 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for producing shaft information in an elevator shaft, comprising: a toothed belt having a plurality of teeth and being adapted to be fixedly mounted in an elevator shaft, said toothed belt being flexible and having a self-tensioning characteristic; and an encoder adapted to be mounted on an elevator car for scanning said teeth during movement of the elevator car in the elevator shaft to generate information which is convertible into travel parameters of the elevator car, said encoder including a toothed wheel engaged with and drivable by said teeth during movement of the elevator car and guide rollers engaging and guiding said toothed belt to ensure a secure engagement of said toothed wheel in said teeth of said toothed belt.

2. The device according to claim 1 wherein said toothed belt includes a reinforcement with spring characteristics which acts as a tensioning element.

3. The device according to claim 2 wherein said toothed belt includes along its length a marking that enables a twist-free mounting in the elevator shaft.

4. The device according to claim 1 wherein said encoder stores an absolute position of the elevator car in a non-volatile manner.

5. The device according to claim 1 wherein said encoder generates absolute positional information of the elevator car enabling determination of the absolute position of the elevator car in the elevator shaft, the speed of the elevator car and the travel direction of the elevator car.

6. A device for producing information related to a position of an elevator car in an elevator shaft comprising:

a toothed belt having a length greater than a length of a travel path of an elevator car in an elevator shaft in which said toothed belt is to be installed, said toothed belt having a plurality of teeth spaced along length thereof, said toothed belt being adapted to be fixedly mounted in the elevator shaft and having a self-tensioning characteristic;

an encoder adapted to be mounted on the elevator car, said encoder having a toothed wheel for engaging said plurality of teeth; and at least one guide roller adapted to be mounted on the elevator car for engaging said toothed belt and urging said plurality of teeth into engagement with said toothed wheel.

7. The device according to claim 6 wherein said toothed belt has spring characteristics for self tensioning when installed in the elevator shaft.

8. The device according to claim 6 including a pair of transverse beams adapted to be fixedly mounted at upper and lower positions in the elevator shaft and wherein opposite ends of said toothed belt are connected to associated ones of said transverse beams.

9. The device according to claim 8 wherein said toothed belt has spring characteristics for self-tensioning when installed in the elevator shaft between said transverse beams.

10. The device according to claim 6 wherein said toothed belt has a marking on at least one side to enable a twist-free mounting in the elevator shaft.

11. The device according to claim 10 wherein said marking is a color of said at least one side.

12. The device according to claim 6 wherein said encoder stores an absolute position of the elevator car in a non-volatile manner.

13. The device according to claim 6 wherein said encoder generates absolute positional information of the elevator car to an associated elevator control enabling determination of the absolute position of the elevator car in the elevator shaft, the speed of the elevator ear and the travel direction of the elevator car.

* * * * *